US009353589B2

(12) United States Patent
Hekelaar

(10) Patent No.: US 9,353,589 B2
(45) Date of Patent: May 31, 2016

(54) MULTI-CYCLE PIPE CUTTER AND RELATED METHODS

(71) Applicant: Smith International, Inc., Houston, TX (US)

(72) Inventor: Stephen Hekelaar, Aberdeen (GB)

(73) Assignee: Smith International, Inc., Houston, TX (US)

( * ) Notice: Subject to any disclaimer, the term of this patent is extended or adjusted under 35 U.S.C. 154(b) by 120 days.

(21) Appl. No.: 13/837,667

(22) Filed: Mar. 15, 2013

(65) Prior Publication Data

US 2013/0199785 A1 Aug. 8, 2013

Related U.S. Application Data

(63) Continuation-in-part of application No. 13/011,492, filed on Jan. 21, 2011, now Pat. No. 8,602,101.

(51) Int. Cl.
*E21B 29/02* (2006.01)
*E21B 29/00* (2006.01)
*E21B 23/00* (2006.01)

(52) U.S. Cl.
CPC ..... *E21B 29/005* (2013.01); *E21B 23/006* (2013.01)

(58) Field of Classification Search
CPC ..... E21B 29/002
See application file for complete search history.

(56) References Cited

U.S. PATENT DOCUMENTS

| | | | | |
|---|---|---|---|---|
| 2,735,485 | A | 2/1956 | Metcalf, Jr. | |
| 2,822,150 | A | 2/1958 | Muse et al. | |
| 2,899,000 | A | 8/1959 | Medders et al. | |
| 3,468,373 | A * | 9/1969 | Smith | 166/55.8 |
| 4,431,065 | A | 2/1984 | Andrews | |
| 4,491,187 | A | 1/1985 | Russell | |
| 5,012,863 | A * | 5/1991 | Springer | 166/55.7 |
| 5,018,580 | A | 5/1991 | Skipper | |
| 5,070,952 | A | 12/1991 | Neff | |
| 5,074,355 | A | 12/1991 | Lennon | |
| 5,253,714 | A * | 10/1993 | Davis et al. | 166/376 |
| 5,265,675 | A | 11/1993 | Hearn et al. | |
| 5,732,770 | A | 3/1998 | Beeman | |
| 5,735,359 | A | 4/1998 | Lee et al. | |
| 7,823,663 | B2 | 11/2010 | Eddison | |

(Continued)

OTHER PUBLICATIONS

International Search Report & Written Opinion issued in corresponding International Application No. PCT/US2012/021871; Dated Aug. 9, 2012 (9 pages).

(Continued)

*Primary Examiner* — William P Neuder

(57) ABSTRACT

A downhole cutting tool includes a tool body and a plurality of cutter knife sets, each of the plurality of cutter knife sets configured to extend outwardly to separately perform a pipe cutting operation. A first cutter knife set has a diameter in an extended position larger than a diameter in an extended position of a second cutter knife set. A method includes running the downhole cutting tool into a wellbore, deploying the first set of expandable cutting arms to an extended position and engaging the extended expandable cutting arms with a first work piece, rotating the downhole cutting tool and cutting the first work piece, deploying the second set of expandable cutting arms during a single trip into the wellbore to an extended position and engaging the extended expandable cutting arms with a second work piece, and rotating the downhole cutting tool and cutting the second work piece.

23 Claims, 13 Drawing Sheets

(56) References Cited

U.S. PATENT DOCUMENTS

| | | | | |
|---|---|---|---|---|
| 8,602,101 | B2 | 12/2013 | Gibson et al. | |
| 2009/0321063 | A1 * | 12/2009 | Bryant et al. | 166/55.1 |
| 2009/0321065 | A1 | 12/2009 | Vinson et al. | |
| 2010/0089583 | A1 | 4/2010 | Xu et al. | |
| 2011/0220357 | A1 | 9/2011 | Segura et al. | |
| 2012/0152543 | A1 | 6/2012 | Davis | |
| 2012/0186817 | A1 | 7/2012 | Gibson et al. | |

OTHER PUBLICATIONS

International Search Report issued in International Application No. PCT/US2014/023492; Dated Jan. 28, 2015 (5 pages).

* cited by examiner

MULTI-CYCLE PIPE CUTTER AND RELATED METHODS

CROSS-REFERENCE TO RELATED APPLICATIONS

The present application is a Continuation-in-Part of U.S. patent application Ser. No. 13/011,492, entitled "Multi-Cycle Pipe Cutter and Related Methods," by Gibson, et al, filed on Jan. 21, 2011, which is incorporated by reference herein in its entirety.

BACKGROUND ART

In oil and gas exploration and development operations it may be desirable to remove casing that has previously been set in the wellbore. In the drilling of oil and gas wells, concentric casing strings are installed and cemented in the borehole as drilling progresses to increasing depths. Each new casing string is supported within the previously installed casing string, thereby limiting the annular area available for the cementing operation. Casing removal involves severing a section of the casing string and pulling the free end to the surface to remove the severed section. A downhole tool having cutters thereon may be run into the casing multiple times to cut and extract sections of casing until complete. For instance, a cutting device may first be lowered into the wellbore to cut the casing at a desired depth, after which the cutting device is returned to the surface. Subsequently, a spearing device may then be lowered downhole to engage a free end of the severed casing. Once the free end of the casing is engaged, the section of severed casing may be pulled from the wellbore.

In certain situations, difficulties may arise in which the severed casing is unable to be pulled from the wellbore, for example, the casing was not severed adequately at a certain location. In this case, the spearing device is removed, the cutting device is reinserted in the wellbore, and a second cut may be made in the casing string at a second location in another attempt to sever the section of casing. Attempts to remove the casing with the spearing device may again be commenced and this process repeated until the section of casing is successfully severed and removed. Depending on the number of cuts required to sever the casing, multiple trips into the wellbore may be required before the casing is severed and removed. Thus, overall time and costs involved in completing a casing extraction may be greatly increased.

SUMMARY OF THE DISCLOSURE

In one aspect, one or more embodiments disclosed herein relate to a downhole cutting tool including a tool body having a piston assembly disposed in a central bore thereof, the piston assembly configured to translate longitudinally along the central axis of the tool body; and a plurality of cutter knife sets, each of the plurality of cutter knife sets including at least two individual cutter knives circumferentially spaced about a central axis of the tool body, each of the plurality of cutter knife sets configured to selectively engage with the piston assembly to extend outward to separately perform a pipe cutting operation, a first cutter knife set of the plurality of cutter knife sets having a diameter in an extended position larger than a diameter in an extended position of a second cutter knife set of the plurality of cutter knife sets.

In another aspect, one or more embodiments disclosed herein relate to a method of operating a cutting tool downhole, the method including running a downhole cutting tool into a wellbore; deploying a first set of expandable cutting arms to an extended position and engaging the extended expandable cutting arms with a first work piece; rotating the downhole cutting tool and cutting the first work piece; deploying a second set of expandable cutting arms during a single trip into a wellbore to an extended position and engaging the extended expandable cutting arms with a second work piece; and rotating the downhole cutting tool and cutting the second work piece.

In another aspect, one or more embodiments disclosed herein relate to a bottomhole assembly including a tool body; a plurality of cutter knife sets coupled to the tool body, each of the plurality of cutter knife sets including at least two individual cutter knives circumferentially spaced about a central axis of the tool body; an underreamer coupled to the tool body; and a casing mill coupled to the tool body.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

Embodiments of multi-cycle pipe cutters and related methods are described with reference to the following figures. The same numbers are used throughout the figures to reference like features and components.

DETAILED DESCRIPTION

Embodiments disclosed herein relate generally to apparatus and methods for cutting casing in a wellbore. More specifically, embodiments disclosed herein relate to apparatus and methods for making multiple casing cuts downhole in a wellbore in a single trip. Embodiments disclosed herein relate to a multi-cycle downhole cutting tool capable of severing a casing at one or more locations in a single trip into a wellbore.

Figure 1:
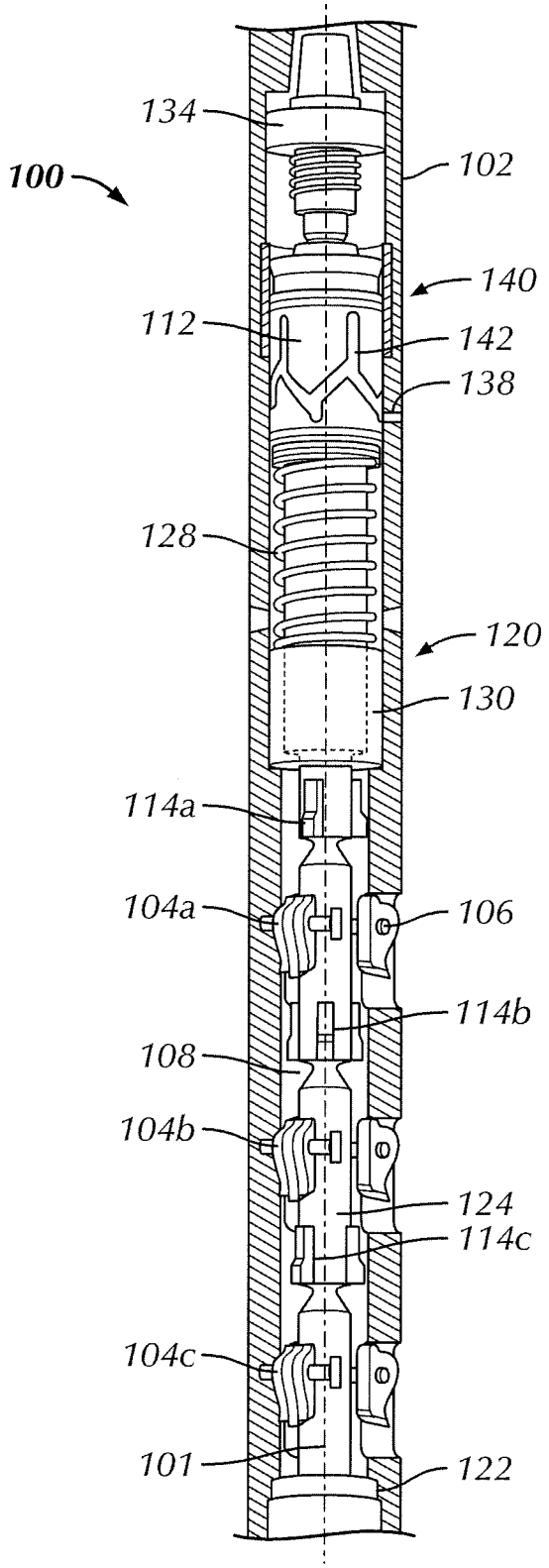
FIG. 1 shows a cross-section view of a multi-cycle downhole cutting tool in accordance with one or more embodiments of the present disclosure.

Referring initially to FIG. 1, a cross-section view of a downhole cutting tool 100 in accordance with one or more embodiments of the present disclosure is shown. The downhole cutting tool 100 may be attached to a distal end of a drillstring (not shown) and disposed within a wellbore and may be configured to make multiple cuts in a casing installed in the wellbore.

The multi-cycle downhole cutting tool 100 includes a tool body 102 having a central bore 108 therethrough and having one or more cutter knife sets 104*a*, 104*b*, 104*c* mounted thereon. Each cutter knife set 104*a*, 104*b*, 104*c* may include one or more individual cutter knives arranged circumferentially about a central axis 101 of the tool body 102. Each individual cutter knife may be pivotably mounted in the wall of the tool body 102, for example by means of a knife hinge pin 106, which allows the individual cutter knife to pivot between a retracted position and an extended position. As used herein, retracted position may be characterized as the position of a cutter knife that has been rotated inward so as to be flush with the tool body (as shown in FIG. 1). Extended position may be characterized as the position of a cutter knife that has been rotated away and extended from the tool body such that a cutting edge of the cutter knife contacts the casing (not shown).

The tool 100 may further include a pressure activated piston assembly 120 disposed within the central bore 108 of the tool body 102, supported at a lower end by a bushing 122 which is configured to center the piston assembly 120 within the central bore 108. The pressure activated piston assembly 120 may be configured to translate longitudinally within the tool body 102 along the central axis 101 in response to an applied fluid pressure provided by, for example, a pump (not shown). The piston assembly 120 includes a piston head 112 and a mandrel 124 extending longitudinally therefrom, the mandrel 124 having a plurality of blade activating lobes 114*a*, 114*b*, 114*c* disposed on an outer surface thereof. The blade activating lobes may be integrally formed with, or attached on the outer surface of the mandrel 124 and may be configured to engage with the corresponding plurality of knife sets 104*a*, 104*b*, 104*c* during longitudinal translation of the piston assembly 120 within the bore 108 to extend the cutter knives.

The piston assembly 120 further includes a spring 128, or other biasing mechanism, disposed about the piston head 112 and a piston stop 130 configured to limit the longitudinal movement of the piston assembly 120 within the central bore 108. Furthermore, the piston assembly 120 may have a central bore (not shown) therethrough which allows for fluid to travel through for fluid communication with additional downhole tools. A pressure drop indicator 134 is also disposed within central bore 108 and is positioned uphole, and in fluid communication with, piston assembly 120. Pressure drop indicator 134 is configured to confirm completion of each casing cut by indicating a pressure drop to an operator when the casing is severed by the cutter knives. In certain embodiments, the pressure drop indicator may include a stationary stinger (not shown) disposed within a bore of piston assembly 120 at the top. An axial length of the stinger may be equal to the axial stroke (required to complete the cut) of the piston assembly 120. A diameter of the stinger may be less than the piston assembly bore diameter. Initially, the stinger stays in the bore creating restricted flow area and thereby requiring higher activation pressure. When the cut is complete, the piston assembly 120 moves downward equal to the stroke thereby clearing the stinger from the bore and removing the flow restriction resulting in drop of the activation pressure. The pressure drop may be in the range of 200-300 psi, which is noticeable on the rig floor. Other devices such as pressure sensors may also be used in conjunction with pulse telemetry or with hard wired connection. In other embodiments, pressure sensors may be used.

Figure 2A:
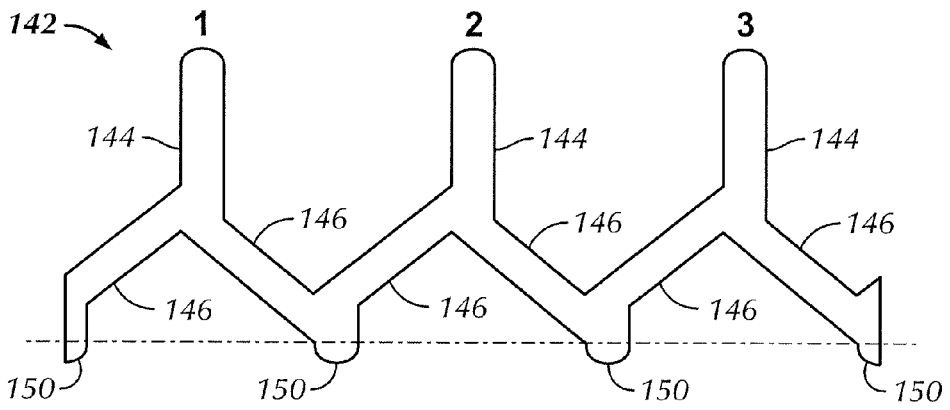
FIGS. 2A and 2B show plan views of an indexing track in accordance with one or more embodiments of the present disclosure.
Figure 2B:
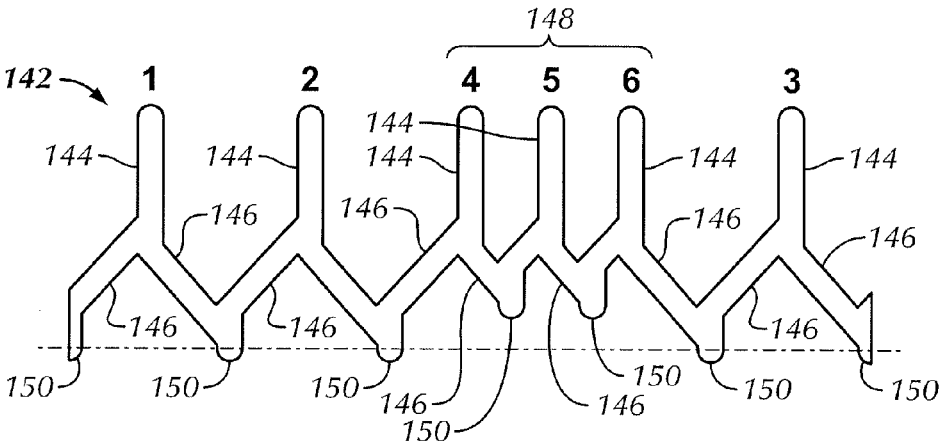
Figure 3A:
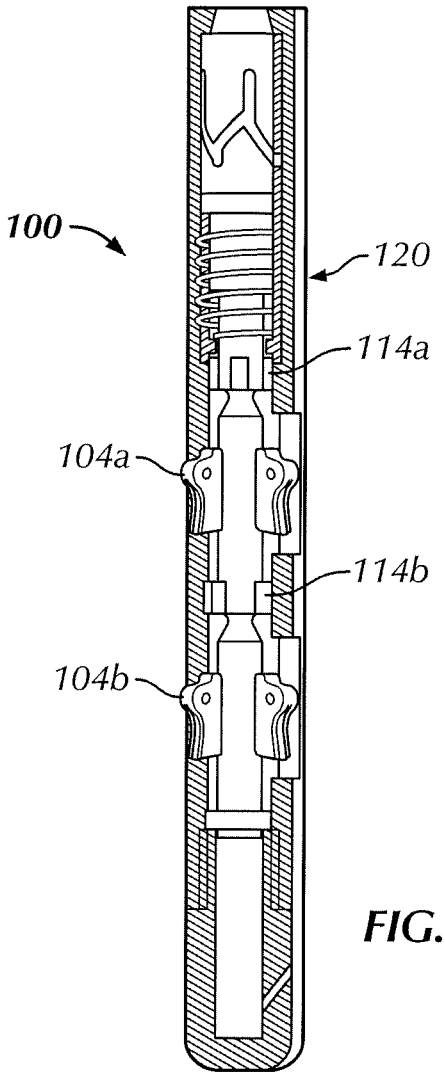
FIGS. 3A and 3B show a cross-section and plan view, respectively, of the multi-cycle downhole cutting tool with cutters disengaged in accordance with one or more embodiments of the present disclosure.
Figure 3B:
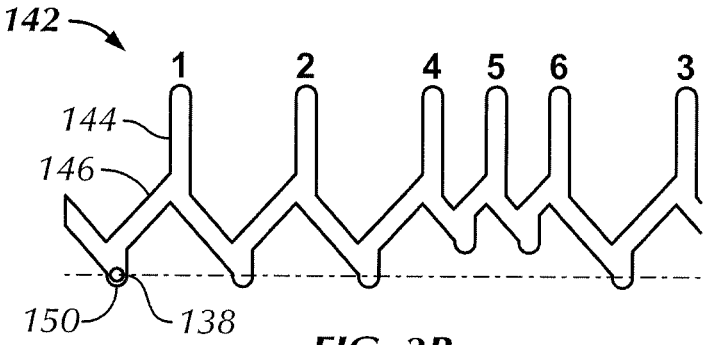

The downhole cutting tool 100 further includes an indexing mechanism 140 disposed at an upper end of the piston assembly 120 and configured to dictate selective engagement between the plurality of blade activating lobes 114*a*, 114*b*, 114*c* and the plurality of cutter knife sets 104*a*, 104*b*, 104*c*. The indexing mechanism 140 includes a circumferential indexing track 142 in which a fixed travel pin 138 is configured to engage. Thus, the engagement of travel pin 138 with indexing track 142 in combination with fluctuations in fluid pressure, results in a predetermined longitudinal and angular motion of the piston assembly 120 relative to tool body 102. FIGS. 2A and 2B show plan views of the indexing track 142 in accordance with one or more embodiments of the present disclosure. As shown in FIG. 2A, indexing track 142 may include multiple track sections configured to manipulate the piston assembly 120 (FIG. 1) into various movements, namely longitudinal track sections 144 and angular track sections 146.

Longitudinal track sections 144 may be arranged circumferentially such that engagement of the travel pin 138 (FIG. 1) with longitudinal track sections 144 is configured to align blade activating lobes (114*a*, 114*b*, 114*c* shown in FIG. 1) with one of the cutter knife sets (104*a*, 104*b*, 104*c* shown in FIG. 1) to be extended. For example, engagement of travel pin 138 within longitudinal track section 144 indicated at "1" and movement therein may cause blade activating lobe 114*a* (FIG. 1) to align with and engage cutter knife set 104*a* (FIG. 1) to extend the cutter knife set. Similarly, engagement of travel pin 138 within longitudinal track section 144 indicated at "2" and movement therein may cause blade activating lobe 114*b* to align with and engage cutter knife set 104*b* to extend the cutter knife set. Still further, engagement of travel pin 138 within longitudinal track section 144 indicated at "3" and movement therein may cause blade activating lobe 114*c* to align with and engage cutter knife set 104*c* to extend the cutter knife set. However, those skilled in the art will appreciate that alternative timing arrangements between longitudinal tracks and cutter knife sets are possible.

Further, indexing track 142 may have angular track sections 146 disposed between the longitudinal track sections 144 and configured to manipulate the piston assembly 120 in simultaneous longitudinal translation and rotation. Thus, engagement of travel pin 138 within angular track sections 146 may cause piston assembly 120 to rotate and translate longitudinally within the tool body as the piston assembly 120 moves between engagement of the multiple cutter knife sets 104*a*, 104*b*, 104*c*. Further, during engagement of the travel pin 138 within angular track sections 146, the blade activating lobes 114*a*, 114*b*, 114*c*, may be misaligned with the cutter knife sets 104*a*, 104*b*, 104*c* such that cutters are retracted.

As shown in FIG. 2B, in certain embodiments, an additional track section 148 may be juxtaposed within the indexing track 142 for timing purposes. The additional track section 148 also includes longitudinal track sections 144 and angular track sections 146; however, circumferential spacing between the longitudinal track sections 144 may be reduced as compared to the spacing of track sections indicated at 1, 2, and 3. In essence, the additional track section 148 may be characterized as a auxiliary track section because no alignment of blade activating lobes/cutter knife sets occurs as the pin 138 travels through the auxiliary track section. Instead, longitudinal and rotational movement of the piston assembly 120 is shortened as the pin 138 travels through the auxiliary track section to return the piston assembly 120 to its proper timing with functional track sections (i.e., track sections indicated at 1, 2, and 3). Furthermore, although three longitudinal track sections are shown in FIG. 2A, alternative embodiments may include additional longitudinal track sections which correspond to additional cutter knife sets. In certain embodiments, indexing track 142 may include transition slots 150 configured to direct the one-way rotational movement of the piston assembly 120 during cycling of the fluid pressure. It will be understood that indexing tracks may be configured to allow for two-way rotational motion, for example, by eliminating lower transition slots 150.

Methods of making multiple casing cuts in a single downhole trip using the multi-cycle downhole cutting tool in accordance with one or more embodiments of the present disclosure are described in reference to FIGS. 3A-6B. Initially, referring to FIGS. 3A and 3B, the downhole pipe cutting tool 100 may be attached to a drill string (not shown) and lowered to an initial depth where the casing is to be cut. In the initial configuration, low or no pressure may be applied to pressure activated piston assembly 120, which may allow the cutter knives 104*a*, 104*b* to remain in a retracted position, as shown. Further, referring to FIG. 3B, travel pin 138 may be initially located in a transition slot 150 (as shown) or an angular track section 146 of indexing track 142 where the cutter knives 104*a*, 104*b* are retracted.

Figure 4A:
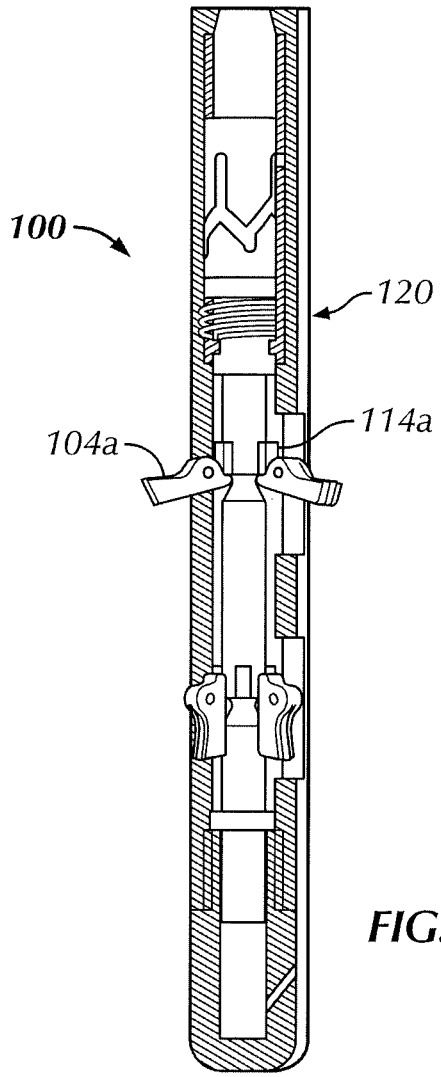
FIGS. 4A and 4B show a cross-section and plan view, respectively, of the multi-cycle downhole cutting tool with a first set of cutters engaged in accordance with one or more embodiments of the present disclosure.
Figure 4B:
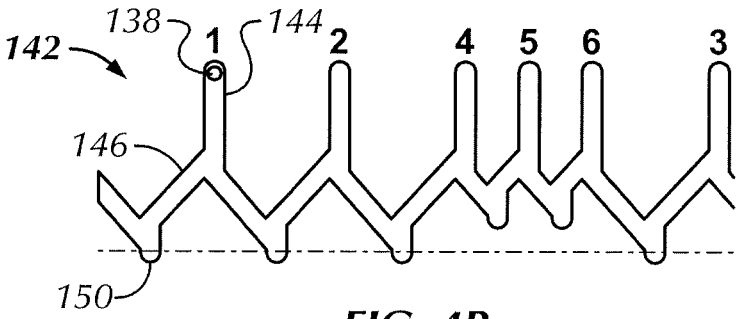

Referring now to FIGS. 4A and 4B, methods of activating a first set of cutter knives 104*a* to an extended position are described in accordance with one or more embodiments of the present disclosure. Fluid pressure acting on pressure activated piston assembly 120 may be increased to move piston assembly 120 longitudinally downward, which also incurs a rotation of pressure activated piston assembly 120 due to engagement between travel pin 138 and angular track section 146. As such, pressure activated piston assembly 120 may be rotated to a position in which blade activating lobe set 114*a* is aligned with and engages a corresponding set of cutter knives 104*a*, resulting in the set of cutter knives 104*a* being deployed to an extended position. Further, as shown in FIG. 4B, cutter knives 104*a* may be fully deployed when travel pin 138 is located at an upper end of the longitudinal track section 144 indicated by position "1."

Figure 5A:
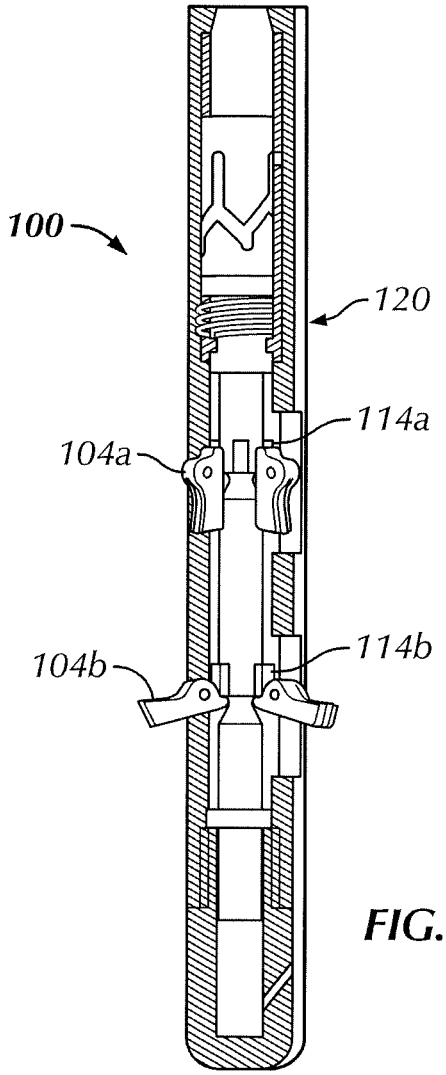
FIGS. 5A and 5B show a cross-section and plan view, respectively, of the multi-cycle downhole cutting tool with a second set of cutters engaged in accordance with one or more embodiments of the present disclosure.
Figure 5B:
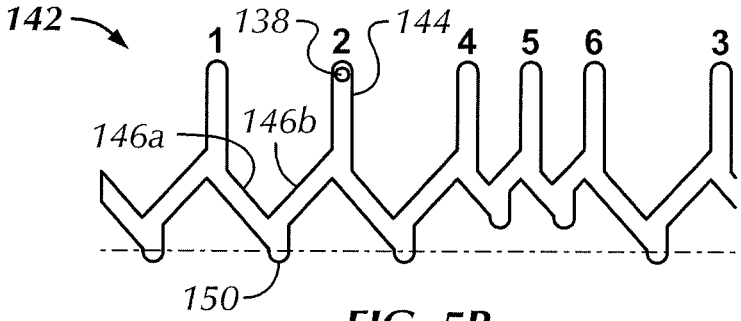

Referring now to FIGS. 5A-5B, methods of activating a second set of cutter knives 104*b* to an extended position are described in accordance with one or more embodiments of the present disclosure. With travel pin 138 starting in the longitudinal track section 144 indicated by position "1," fluid pressure acting on pressure activated piston assembly 120 may be decreased to allow piston assembly 120 to move longitudinally upward (biased by spring mechanism 128 in FIG. 1), which also incurs a rotation of pressure activated piston assembly 120 due to engagement between travel pin 138 and angular track section 146A. Cutter knives 104*a* and blade activating lobes 114*a* are disengaged and cutter knives 104*a* are retracted.

Fluid pressure acting on pressure activated piston assembly 120 is again increased to move piston assembly 120 longitudinally downward, which further rotates piston assembly 120 due to engagement between travel pin 138 and angular track section 146B. As such, pressure activated piston assembly 120 may be rotated to a position in which blade activating lobe set 114*b* is aligned with and engages a corresponding set of cutter knives 104*b*, resulting in the set of cutter knives 104*b* being deployed to an extended position. Cutter knives 104*b* are fully deployed when travel pin 138 is located at an upper end of the longitudinal track section 144 indicated by position "2," as shown in FIG. 5B.

Figure 6A:
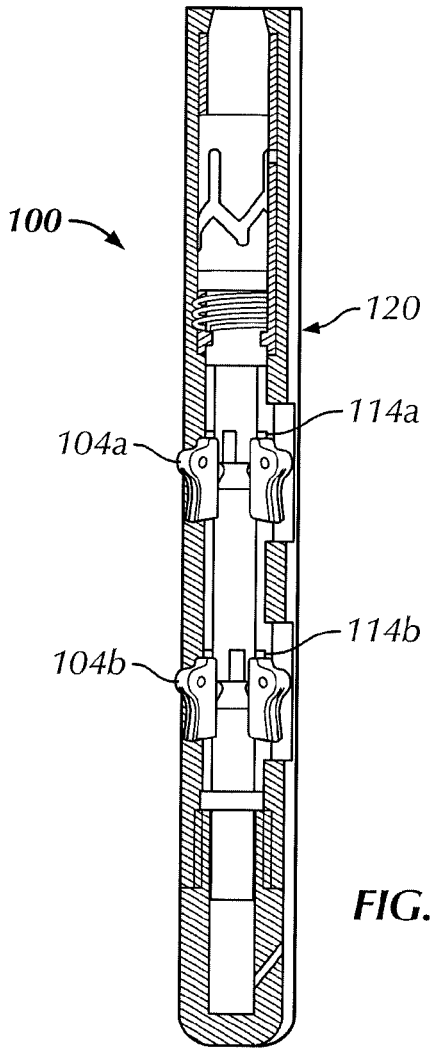
FIGS. 6A and 6B show a cross-section and plan view, respectively, of the multi-cycle downhole cutting tool with cutters disengaged in accordance with one or more embodiments of the present disclosure.
Figure 6B:
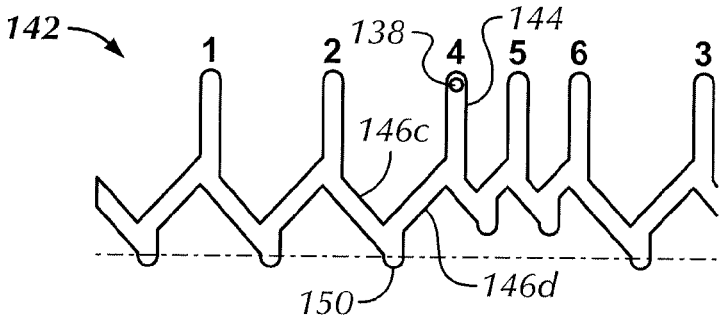

Referring now to FIGS. 6A-6B, methods of pressurizing pressure activated piston assembly 120 without activating any sets of cutter knives are described in accordance with one or more embodiments of the present disclosure. With travel pin 138 starting in the longitudinal track section 144 indicated by position "2," fluid pressure acting on piston assembly 120 is decreased to allow piston assembly 120 to move longitudinally upward, which again incurs a rotation of pressure activated piston assembly 120 due to engagement between travel pin 138 and angular track section 146*c*. Subsequently, fluid pressure acting is again increased to move piston assembly 120 back longitudinally downward and rotating the piston 120 due to engagement between travel pin 138 and angular track section 146*d*. As such, pressure activated piston assembly 120 may be rotated to a position in which the blade activating lobe sets 114*a* or 114*b* are not aligned with any corresponding sets of cutter knives 104*a* or 104*b*, respectively. In this case, travel pin 138 may be located at an upper end of the longitudinal track section 144 indicated by position "4," as shown in FIG. 6B. The pin 138 may continue to travel through track sections 4, 5, and 6 without deploying cutter knives.

Methods of making multiple cuts in the casing with the multi-cycle downhole cutting tool as described above may proceed as follows. With the set of cutter knives 104*a* in an extended position (shown in FIG. 4A), a first cut in the casing may be made by rotating the tool in the wellbore, for example, by rotating the drillstring to which the upper end of the tool is attached. In certain embodiments, completion of the cut may be verified by a pressure drop indicator (not shown) disposed within the cutting tool that registers the corresponding fluid pressure drop when the wall of the casing has been severed.

After the first cut is completed, an attempt may be made to remove the first cut section of the casing from the wellbore. For example, removal attempts may be made by activating any type of downhole tool (not shown) capable of engaging a casing, for example, a spearing or grappling tool, and pulling upward on the casing. If the casing has been adequately severed by the first cut, the severed casing section may then be removed by withdrawing the drillstring from the wellbore. In addition, other devices typically used during a casing removal process may be engaged, for example, a jarring device may also be used during the removal process to help free the cut casing segment.

If the first cut section of the casing is unable to be removed for any reason, or if a second cut is desired, a second cut may be attempted at the same or a different location along the casing using the same or a different set of cutter knives. Before the second cut attempt, the drillstring may be raised or lowed in the wellbore if it is desired to make the second cut at a new location along the casing. Furthermore, if it is determined that a different set of cutter knives should be used, for example, cutter knives 104*b* (shown in FIGS. 5A and 5B), the fluid pressure to the pressure activated piston head 112 may be cycled (e.g., off and on) such that the second blade activating lobe set 114*b* engages with the corresponding second set of cutter knives 104*b*, resulting in the second set of cutter knives 104*b* being deployed to an extended position. A second cut is then made in the casing using the second set of cutter knives 104*b* in a manner similar to that described above for the first casing cut. Subsequently, another attempt at removal of the casing is made.

Furthermore, another downhole tool that is attached to the cutting tool 100 may be operated by moving the piston assembly 120 from the configuration shown in FIG. 5A to the auxiliary configuration shown in FIG. 6A. In this example, the pressure is cycled once to move from the longitudinal track section 144 indicated by position "2" in FIG. 5B to the auxiliary longitudinal track section indicated by position "4" in FIG. 6B. In this configuration, pressure may be applied to another tool through the fluid communication allowed by a central bore (not shown).

The above steps may be repeated numerous times to make any number of cuts, as required by the casing removal operation. One of ordinary skill in the art will appreciate that, depending on the cutting operation, the number of cutter knives per set, the number of cutter knife sets, and even the number of downhole cutting tools disposed in the wellbore may vary. As such, in certain embodiments, the multi-cycle cutting tool may include more or less than three cutter knife sets, with each cutter knife set including any number of individual cutters. One of ordinary skill in the art will recognize that the order in which the cutter knife sets are deployed may be varied (i.e., cutter set 104*b* deployed first followed by cutter knife set 104*a*). In addition, according to one or more embodiments of the present disclosure, the pressure activated piston assembly may be cycled to a position where no cutter knife sets are engaged. In this configuration, another tool may be activated without activating any of the cutter knife sets.

Figure 7:
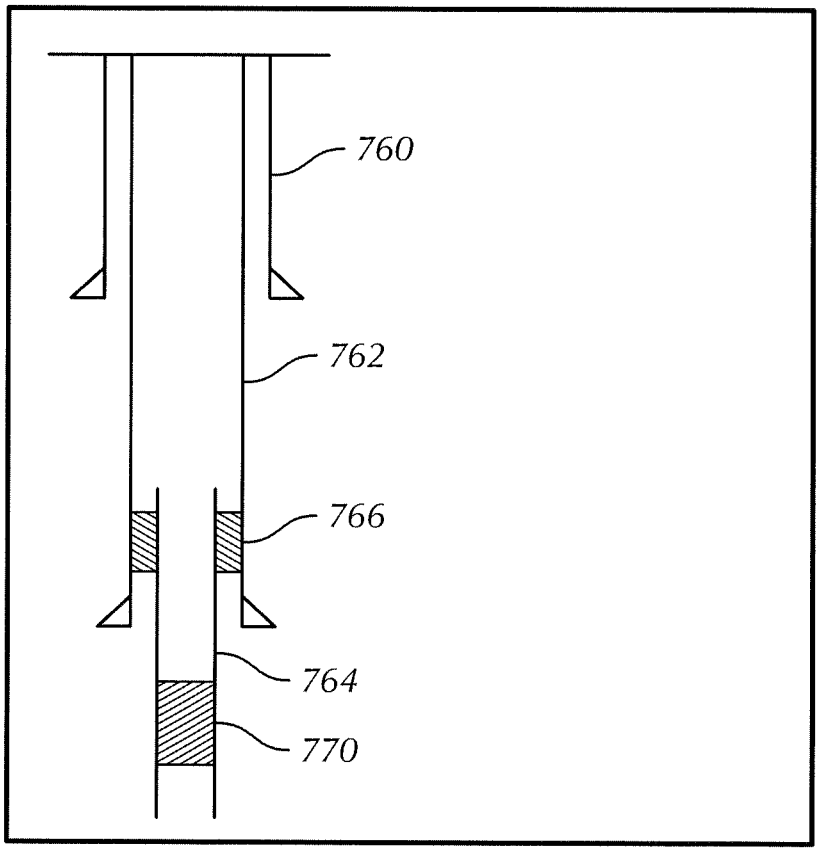
FIG. 7 is a schematic of casing disposed in a borehole in accordance with one or more embodiments of the present disclosure.

In some embodiments, the downhole pipe cutting tool 100 may be used to make one or more cuts through multiple strings of casing. One of ordinary skill in the art will appreciate that when casing is run downhole and cemented in place, various casings may overlap, i.e., at least a portion of a first casing may be disposed radially outward of a second casing. For example, as shown in FIG. 7, after a first section of the borehole is drilled, a first casing 760 may be run down hole and set in position. A second section of the borehole may then be drilled below the first casing 760. A second casing 762, smaller in diameter than the first casing 760, may then be run downhole through the first casing and set in position, wherein at least a portion of the upper end of the second casing 762 overlaps a lower portion of the first casing 760. The borehole may be continued to be drilled below the second casing. A third casing 764, smaller in diameter than the first and second casings 760, 762 may be run downhole through the first and second casings 760, 762, and set in position, wherein at least a portion of the upper end of the third casing 764 overlaps a lower portion of the second casing 762. In some embodiments, the second and/or third casings 762, 764 may be production casings. In other words, the second and/or third casings 762, 764 may be a casing string that is set across a reservoir interval and within which the primary completion components are installed. The production casing may then be perforated to allow fluid communication between the formation and the bore of the production casing. As further shown, a production packer 766 may be disposed between casing members, e.g., the second and third casings 762, 764 to seal between the second and third casings 762, 764.

Figure 8:
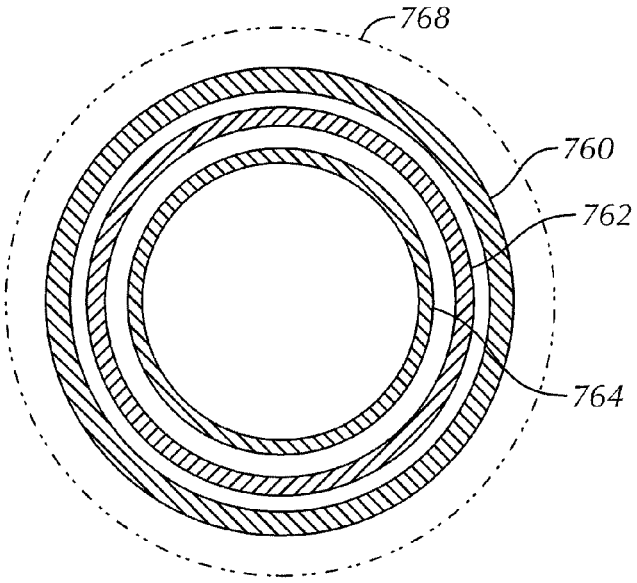
FIG. 8 is a cross-sectional view of multiple casing segments disposed in a borehole in accordance with one or more embodiments of the present disclosure.
Figure 9:
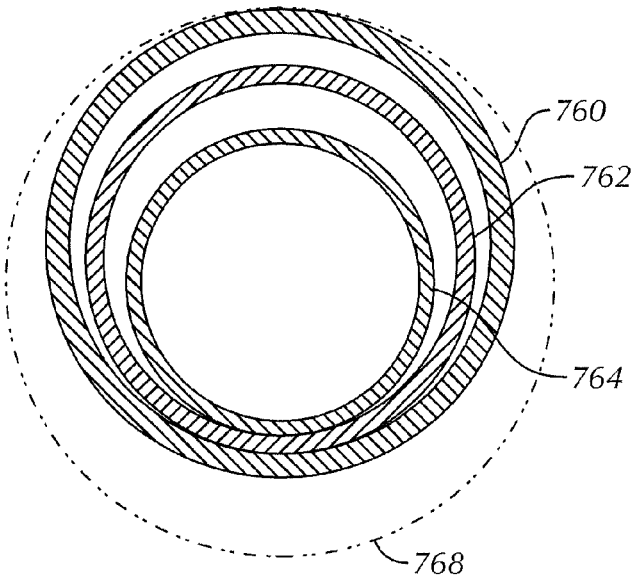
FIG. 9 is a cross-sectional view of multiple casing segments disposed in a borehole in accordance with one or more embodiments of the present disclosure.

Although FIG. 7 shows two casings overlapping, one of ordinary skill in the art will appreciate that in other embodiments three or more casing members may overlap. For example, as shown in FIGS. 8 and 9, in some embodiments at least a portion of three casing members may radially overlap within a borehole 768. In some embodiments, the first casing 760, the second casing 762, and the third casing 764 may be concentrically disposed within one another and within the borehole 768, as shown in FIG. 8. In some embodiments, the first casing 760, the second casing 762, and the third casing 764 may be eccentrically disposed within one another and within the borehole 768, as shown in FIG. 9. In yet other embodiments, the first casing 760, the second casing 762, and the third casing 764 may be disposed in a combination of concentric and eccentric positions within one another and within the borehole 768.

The downhole pipe cutting tool 100 in accordance with embodiments disclosed herein may be configured to cut through more than one casing in a single trip. Thus, with reference to FIGS. 8 and 9, the downhole pipe cutting tool 100 may be run downhole and cut the first, second and third casings 760, 762, 764 in a single trip.

Referring now to FIGS. 1, 8, and 9 together, in one embodiment, the downhole pipe cutting tool 100 may include one or more cutter knife sets 104*a*, 104*b*, 104*c*. Each cutter knife set 104*a*, 104*b*, 104*c* may have a different cutting diameter, such that a diameter of each cutter knife set 104*a*, 104*b*, 104*c* in the extended position is configured to contact and cut casings having different diameters. For example, a length of each cutting knife of the first cutter knife set 104*a* may be shorter than a length of each cutting knife of the second cutter knife set 104*b*. Therefore, when the cutter knife sets are actuated into the extended portion, the cutting diameter of the second cutter knife set 104*b* is greater than the cutting diameter of the first cutter knife set 104*a*. While reference is made herein to three cutter knife sets and three casings, one of ordinary skill in the art will appreciate that more or less than three cutter knife sets may be used in accordance with embodiments disclosed herein.

In one embodiment, each cutter knife set 104*a*, 104*b*, 104*c* is configured to be individually actuated. In other words, the first cutter knife set 104*a* may be actuated to cut the inner/innermost casing, e.g., third casing 764, the second cutter knife set 104*b* may be actuated to cut the outer casing, e.g., second casing 762, and the third cutter knife set 104*c* may be actuated to cut the next outer casing, e.g., first casing 760. In some embodiments, the cutter knife sets 104*a*, 104*b*, 104*c* may be actuated sequentially; in other embodiments, the cutter knife sets 104*a*, 104*b*, 104*c* may be selectively actuated. Actuation of each cutter knife set 104*a*, 104*b*, 104*c* may be performed in a single trip of the downhole pipe cutting tool 100. Each cutter knife set 104*a*, 104*b*, 104*c* may be actuated by the pressure activated piston assembly 120, discussed above.

Methods of making multiple cuts in the multiple strings of casing with the multi-cycle downhole cutting tool as described above may proceed as follows, with reference to FIGS. 10 and 11, which show two overlapping casings 760, 762. With the first set of cutter knives 104*a* in an extended position (shown in FIG. 4A), a first cut in the inner/innermost casing, e.g., second casing 762 may be made by rotating the tool in the wellbore, for example, by rotating the drillstring to which the upper end of the tool is attached (shown in FIG. 10). In certain embodiments, completion of the cut may be verified by a pressure drop indicator (not shown) disposed within the cutting tool that registers the corresponding fluid pressure drop when the wall of the casing has been severed. After the first cut is completed, the first set of cutting knives 104*a* may be de-actuated such that the first set of cutting knives 104*a* are collapsed to the retracted position. The tool may then be raised or lowered an amount equal to a distance between the first set of cutter knives 104*a* and the second set of cutter knives 104*b* (shown in FIG. 5A), so that the second set of cutter knives 104*b* is axially aligned with the casing cut made by the first set of cutter knives 104*a*. The second set of cutter knives 104*b*, are then moved into the extended position by actuation of the pressure activated piston assembly 120 into contact with the outer casing, e.g., first casing 760 (shown in FIG. 11). The second casing is cut by rotating the tool in the wellbore, for example, by rotating the drillstring to which the upper end of the tool is attached.

The above steps may be repeated numerous times to make any number of cuts, as required by the casing removal operation. One of ordinary skill in the art will appreciate that, depending on the cutting operation, the number of cutter knives per set, the number of cutter knife sets, and even the number of downhole cutting tools disposed in the wellbore may vary. As such, in certain embodiments, the multi-cycle cutting tool may include more or less than three cutter knife sets, with each cutter knife set including any number of individual cutters. One of ordinary skill in the art will recognize that the order in which the cutter knife sets are deployed may be varied (i.e., cutter set 104*b* deployed first followed by cutter knife set 104*a*). In addition, according to one or more embodiments of the present disclosure, the pressure activated piston assembly may be cycled to a position where no cutter knife sets are engaged. In this configuration, other actuatable components of the downhole cutting tool 100 may be activated without activating any of the cutter knife sets.

For example, the downhole cutting tool 100 may include an underreamer or a downhole milling tool. In some embodiments, the downhole cutting tool 100 may include one or more expandable underreamer arms or casing milling arms. In other embodiments, an underreamer or downhole casing mill tool may be coupled to the downhole cutting tool 100. For example, an underreamer may be coupled above the downhole cutting tool 100. Thus, a bottom hole assembly (BHA) according to embodiments disclosed herein may include a cutting tool having one or more knife cutters, an underreamer, and a casing mill. One example underreamer that may be used in accordance with embodiments disclosed herein is shown in U.S. Pat. No. 4,431,065, assigned to the assignee of the present application, and one example casing mill that may be used in accordance with embodiments disclosed herein is shown in U.S. Pat. No. 5,070,952, assigned to the assignee of the present application are known in the art, both of which are incorporated by reference in their entireties. One of ordinary skill in the art will appreciate that various underreamers and casing mills are known in the art and may be used with a BHA in accordance with embodiments disclosed herein. A BHA according to the present disclosure may provide for cutting of casing, milling of casing, and underreaming of the formation all in a single trip of the BHA downhole. In some embodiments, the BHA may be lowered into a borehole and two of the components may be operated in a single trip, for example, the casing mill and the underreamer may be operated.

Figure 16:
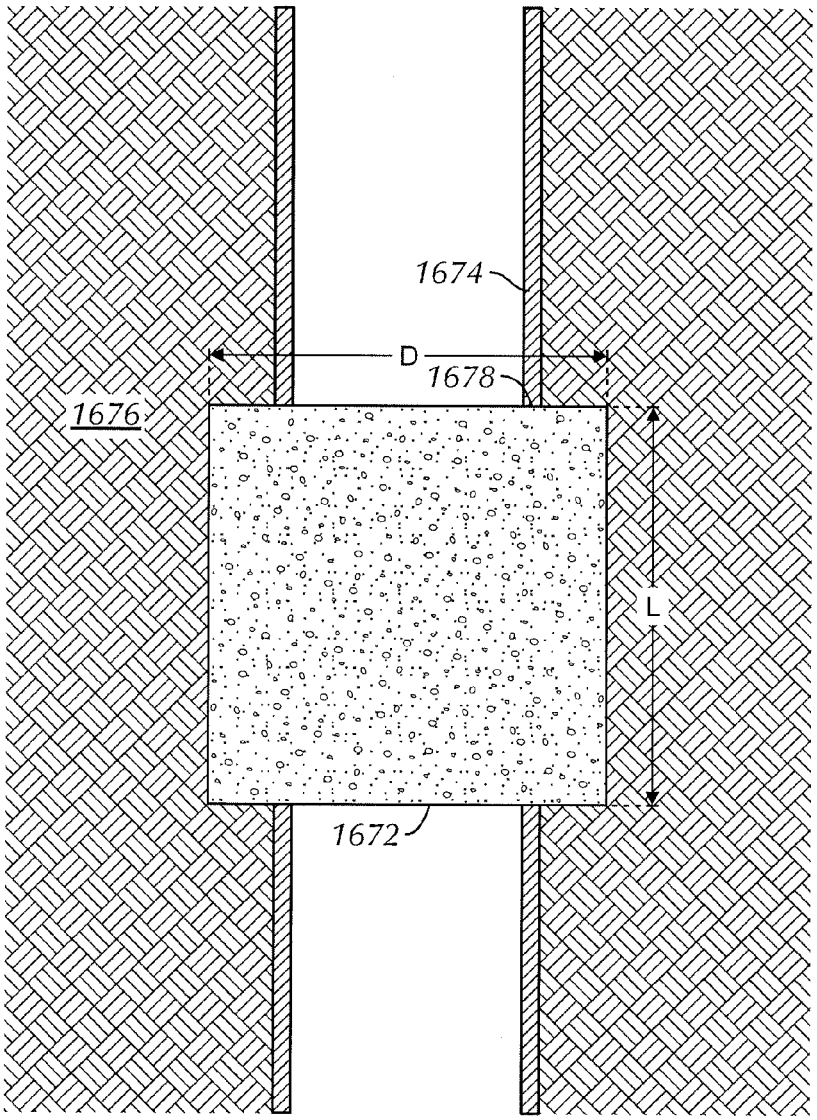
FIG. 16 is a schematic of a cement plug set in a wellbore in accordance with one or more embodiments of the present disclosure.

In abandonment of wells or partial abandonment of wells, e.g., for sidetracking, various operations may be performed to prepare the borehole for setting a cement plug. A cement plug 770 may be set within a casing, as shown in FIG. 7, or alternatively, a cement plug may be set within an uncased portion of the borehole (not shown). Cemented casing may provide a potentially hazardous leak path if the cement between the casing and the formation was improperly set or damaged. As shown in FIG. 16, in order to ensure the strength and efficiency of a cement plug 1672, a section of casing 1674 may be cut and removed or milled from a borehole before setting the cement plug 1672 across the formation 1676 as a permanent barrier. For example, a window 1678 or opening having a length 1 may be milled in the casing 1674. Then, the formation 1676 may be underreamed to an underreamer diameter d in the milled section of the casing 1674 (i.e., through the window 1678) so as to enlarge the diameter of the borehole and provide a larger area in which to set the cement plug 1672. Before the cement plug 1672 is set, one of ordinary skill in the art will appreciate that a bridge plug (not shown), as known in the art, may be set in the borehole below a location where the cement plug is to be set. For example, a bridge plug may be set in the casing section below the window 1678 to seal the bore of the wellbore, thereby allowing the cement plug 1672 to be set.

Thus, methods of using a BHA in accordance with embodiments disclosed herein may proceed as follows. First, a BHA having two or more of the following components: (a) knife cutters, (b) an underreamer, and (c) a casing mill is run downhole to a determined location at or near a location where the cement plug is to be set. One of ordinary skill in the art will appreciate that at the determined location, there may be one or more casing segments disposed in the borehole. In one embodiment, the casing mill is actuated to mill a section of the casing. The casing mill may mill a length of the casing, for example, 200-300 axial feet of casing, by contacting a milling cutter of the casing mill with the casing and rotating the drill string. Once the designed length of casing has been removed (i.e., milled) from a section of the borehole, the milling cutters may be deactuated. The BHA may then be moved downhole and the underreamer may be actuated. The underreamer may include a plurality of cutting arms which, when actuated, extend into contact with the formation. A plurality of cutters contact and cut the formation as the BHA is rotated. The underreamer may, thus, cut or underream the formation in a window created by the just milled section of the casing to a larger diameter than an initial diameter. The casing milling and underreaming as described above is performed in a single trip by actuation of the various components of the BHA described herein.

Figure 10:
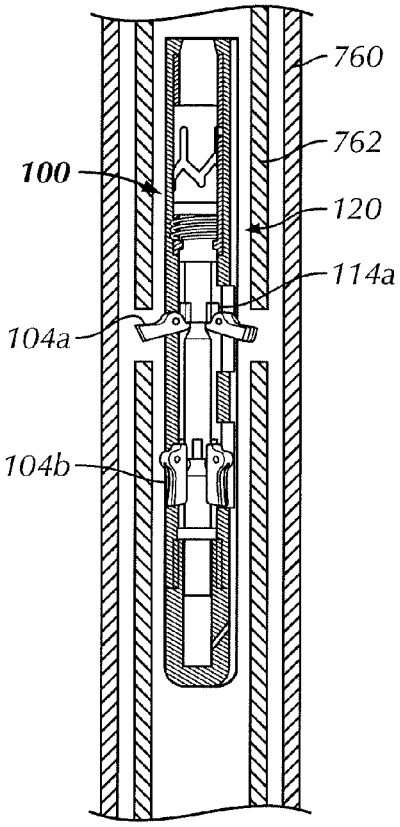
FIG. 10 is a cross-sectional view of a multi-cycle downhole cutting tool disposed within multiple casing segments in accordance with one or more embodiments of the present disclosure.
Figure 11:
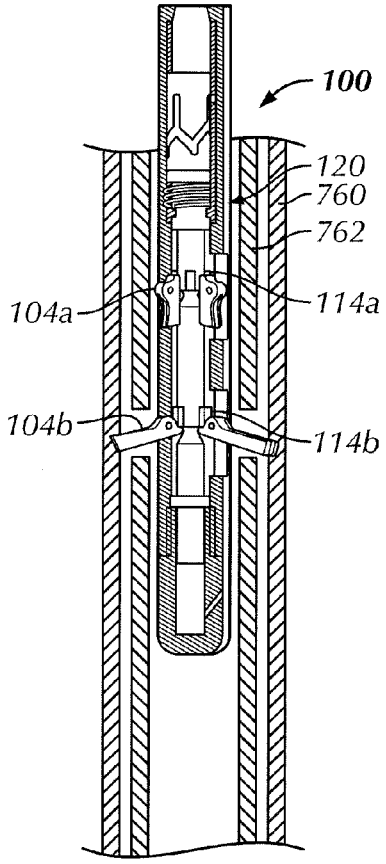
FIG. 11 is a cross-sectional view of a multi-cycle downhole cutting tool disposed within multiple casing segments in accordance with one or more embodiments of the present disclosure.
Figure 17:
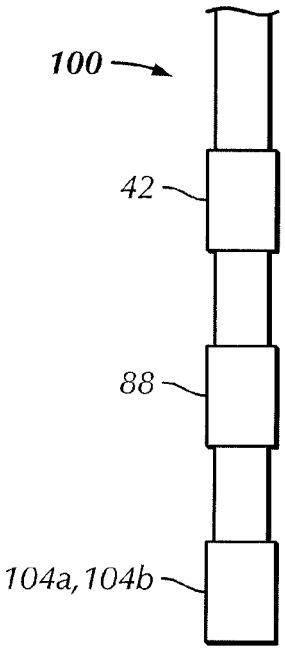
FIG. 17 is a schematic of a downhole cutting tool including underreamer cutting arms, milling cutters, and a cutter knife set in accordance with one or more embodiments of the present disclosure.
Figure 18:
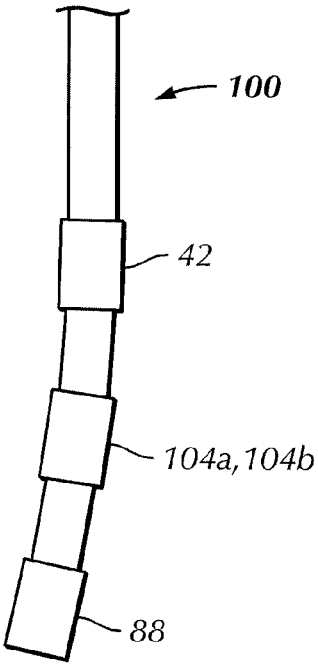
FIG. 18 is a schematic of a downhole cutting tool including underreamer cutting arms, a cutter knife set, and milling cutters in accordance with one or more embodiments of the present disclosure.

In other embodiments, with reference to FIGS. 10 and 11, the downhole cutting tool 100, may include multiple sets of expandable cutting arms. For example, the multiple sets of expandable cutting arms may include one or more sets of cutter knife sets 104*a*, 104*b*, one or more sets of milling cutters (e.g., cutters 88 in FIGS. 12 and 13), and one or more sets of underreamer cutting arms (e.g, underreamer cutting arm 42 in FIGS. 14 and 15). In this example, each set of expandable cutting arms may be disposed azimuthally about the downhole cutting tool 100. The order of the sets of expandable cutting arms on the downhole cutting tool 100 may vary depending on the application and formation or casing being cut, as shown in FIGS. 17 and 18. For example, the cutter knife set 104*a*, 104*b* may be disposed axially below the underreamer cutting arms 42 and the milling cutters 88, as shown in FIG. 17. In other embodiments, the milling cutters 88 may be disposed axially below the cutter knife set 104*a*, 104*b* and the underreamer cutting arms 42, as shown in FIG. 18.

Figure 12:
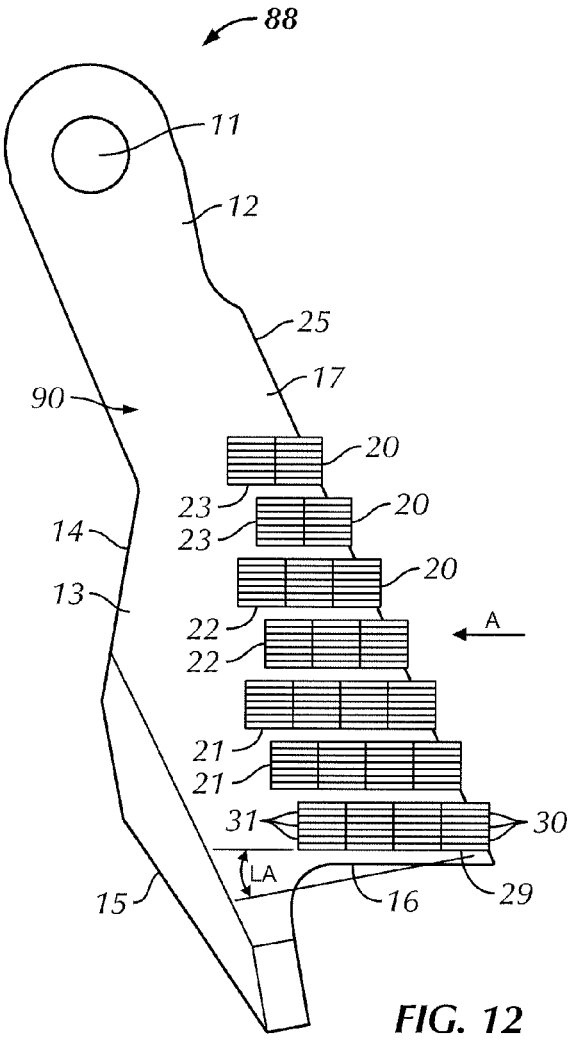
FIG. 12 is a side view of a casing mill cutter in accordance with one or more embodiments of the present disclosure.
Figure 13:
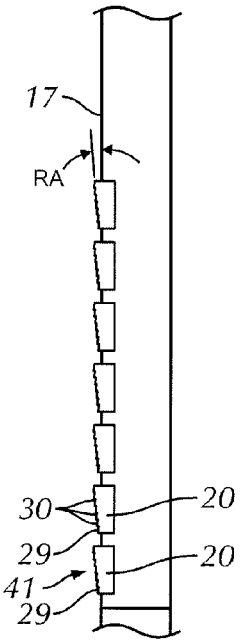
FIG. 13 is a partial side view in the direction of arrow-headed line A of FIG. 12 in accordance with one or more embodiments of the present disclosure.

FIGS. 12 and 13 show an example milling cutter 88 that may be coupled to the downhole tool 100. Milling cutter 88 includes a longitudinally extending blade 90, the upper end having a circular hole 11 through which a pivot (not shown) is located. The blade 90 has a necked portion 12 in which the circular hole 11 is disposed. The blade 90 broadens out to a main portion 13 having a radially inner side 14 which links to an approximately triangularly cross-sectioned rib 15. The lower part of the blade 90 has an L-shaped cutout to provide a lower, in use, edge 16.

Located over a leading surface 17 of the blade, i.e. facing forwardly in the direction of rotation of the tool, is a plurality of cutting elements 20, the elements being secured to the blade by any convenient means known in the art, such as by brazing, welding or soldering. The cutting elements are positioned in radial rows 21, 22, 23. Each of the rows 21, 22, 23 is located in a longitudinal direction one above the other. Each of the rows are staggered with respect to an adjacent row such that odd numbered rows starting from the lower edge 16 and extending upwardly in the longitudinal direction are located to align with one another and the even numbered rows are located to align with one another, the odd numbered rows being offset from the even numbered rows by about half the radial length of a cutting element, thereby forming a "brickwork" pattern. In the arrangement shown in FIG. 12, the cutting element at the radial outermost end of each row is arranged to have the lower radial outer corner in alignment with a sloping edge 25 of the blade 90.

Each cutting element 20 has a cutting edge 29 and a plurality of protruding ridges 30, each cutting edge 29 extending radially and each cutting edge 29 being spaced from an adjacent cutting edge a selected distance in a longitudinal direction. Each protruding ridge is inter-spaced between one another by a recessed portion 31. The cutting edge 29 and each of the protruding ridges 30 of adjacent cutting elements 20 align with one another in a radial direction and each of the rows 21, 22, 23 of cutting elements 20 are inclined relative to a line which is perpendicular to the longitudinal axis, i.e. have a lead attack angle LA which is in the range 1-15 degrees, for example 10 degrees. The milling cutter 88 shown in FIGS. 12 and 13 is just one example of a milling cutter that may be used in accordance with embodiments disclosed herein.

Figure 14:
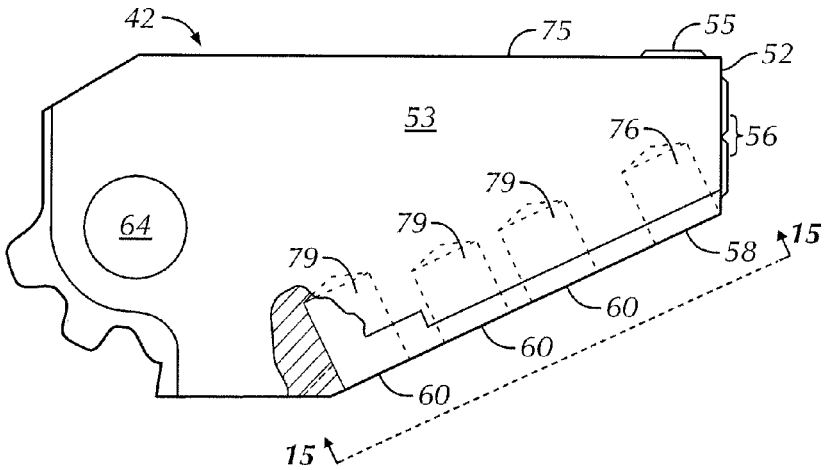
FIG. 14 is a side elevation of a underreamer cutting arm in accordance with one or more embodiments of the present disclosure.
Figure 15:
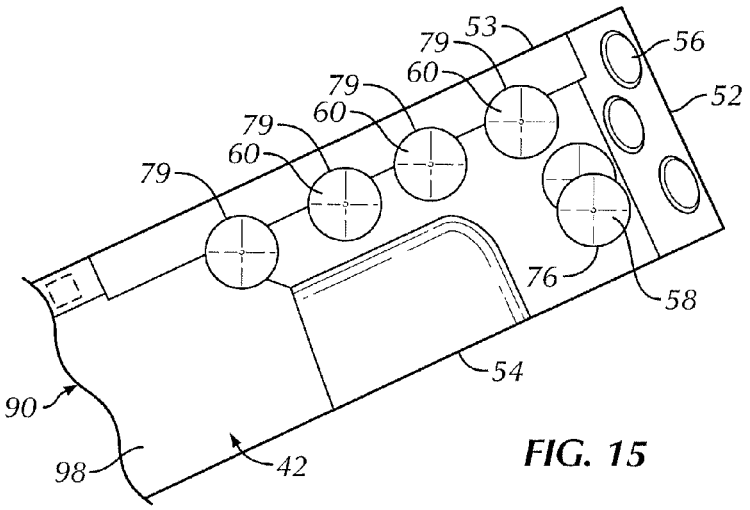
FIG. 15 is a bottom view of the underreamer cutting arm of FIG. 14.

FIGS. 14 and 15 show an example of an underreamer cutting arm 42 that may be used with the downhole cutting tool 100 in accordance with the present disclosure. Underreamer cutting arm 42 includes a hinge pin passage 64 near the inner end portion of the arm 42 for hingeably mounting the cutting arm in the underreamer or downhole cutting tool 100. The underreamer cutting arm 42 includes an outer end portion 52, a top side 75, a bottom side 98, and a leading side 53 and a trailing side 54 which are defined by reference to the intended direction of rotation of the underreamer in operation.

Each underreamer cutting arm 42 may include a plurality of tungsten carbide inserts. For example, each underreamer cutting arm 42 may include one or more of the following: one or more cylindrical tungsten carbide inserts 55 on the top of the underreamer cutting arm 42, a plurality of cylindrical tungsten carbide inserts 56 on the outer end portion 52 of the underreamer cutting arm 42, a tungsten carbide insert including a synthetic diamond cutting face forming gage cutter 58, and a plurality of additional or auxiliary tungsten carbide inserts having cutting faces forming synthetic diamond cutters 60 of the underreamer cutting arm 42. Although referred to herein as "auxiliary cutters" it will be understood that these cutters 60 collectively cut the rock in reaming a bore hole. The term "auxiliary" is used herein merely to distinguish such cutters from the gage cutters 58 disposed in bores 76. As shown in FIG. 15, synthetic diamond cutters 60 may be disposed in bores 79 on the bottom side 98 of the underreamer cutting arm 42. The synthetic diamond cutters 60 may be located on the bottom side 98 closer to the leading side 53 than the trailing side 54 of the underreamer cutting arm 42. The tungsten carbide inserts 56 located on the outer end portion 52 of the arm 42 are adjacent the gage of the hole during underreaming and help maintain the gage as well as protect the end portion of the arm 42 from premature wear. The underreamer cutting arm 42 shown in FIGS. 14 and 15 is just one example of an underreaming cutting arm that may be used in accordance with embodiments disclosed herein. One of ordinary skill in the art will appreciate that other cutting arms having different configurations, for example, of cutter placement, number of cutters, etc., as well as different materials, and actuation mechanisms may be used without departing from the scope of embodiments disclosed herein.

Each of the expandable cutting arms described herein may be actuated or deactuated (i.e., moved into an extended position or a retracted position) by the piston assembly 120 described above. Thus, in accordance with methods of operating the downhole cutting tool 100 of the present disclosure with reference to FIGS. 4-6, fluid pressure acting on pressure activated piston assembly 120 may be increased to move piston assembly 120 longitudinally downward, which also incurs a rotation of pressure activated piston assembly 120 due to engagement between travel pin 138 and angular track section 146. As such, pressure activated piston assembly 120 may be rotated to a position in which blade activating lobe set 114*a* is aligned with and engages a corresponding set of cutter knives 104*a*, resulting in a first set of expandable cutting arms, e.g, the set of cutter knives 104*a*, a set of milling cutters 88, or a set of underreamer cutting arms 42, being deployed to an extended position.

A second set of expandable cutting arms, e.g., the set of cutter knives 104*b*, the set of milling cutters 88, or the set of underreamer cutting arms 42, may then be actuated to an extended position. With reference to FIGS. 1, 5A, and 5B, the second set of expandable cutting arms may be actuated to the extended position as follow. Travel pin 138 is positioned in the longitudinal track section 144 indicated by position "1." Fluid pressure acting on pressure activated piston assembly 120 may be decreased to allow piston assembly 120 to move longitudinally upward (biased by spring mechanism 128 in FIG. 1), which also incurs a rotation of pressure activated piston assembly 120 due to engagement between travel pin 138 and angular track section 146A (as shown in FIG. 5B). The first set of expandable cutting arms, e.g., cutter knives

104*a*, and blade activating lobes 114*a* are disengaged and the first set of expandable cutting arms are retracted.

Fluid pressure acting on pressure activated piston assembly 120 is again increased to move piston assembly 120 longitudinally downward, which further rotates piston assembly 120 due to engagement between travel pin 138 and angular track section 146B. As such, pressure activated piston assembly 120 may be rotated to a position in which blade activating lobe set 114*b* is aligned with and engages a corresponding second set of expandable cutting arms, resulting in the second set of expandable cuttings arms being deployed to an extended position. The second set of expandable cutting arms are fully deployed when travel pin 138 is located at an upper end of the longitudinal track section 144 indicated by position "2," as shown in FIG. 5B.

Actuation of one or more sets of expandable cutting arms may thus be accomplished by adjusting the pressure acting on pressure activated piston assembly 120. Actuation of one or more sets of the expandable cutting arms may also be based on the application or cutting action to be performed. Including multiple expandable cutting arms on the downhole cutting tool 100, or providing a BHA with the downhole cutting tool 100, an underreamer and/or casing mill, allows multiple operations for removing casing to be performed in a single trip.

One or more embodiments disclosed herein provide a multi-cycle downhole pipe cutting tool that may be used to make multiple cuts in a single casing with only a single downhole trip of the tool. Thus, overall time and costs involved in completing a casing extraction may be greatly reduced. One or more embodiments disclosed herein also provide a multi-cycle downhole pipe cutting tool that may be used to make one or more cuts in multiple casing segments. Further, one or more embodiments disclosed herein also provide a bottomhole assembly that includes an underreamer, a casing mill, and one or more knife cutters. Each component (the underreamer, the casing mill, and the knife cutters) may be individually actuated so that various operations may be separately and independently performed in a single trip downhole.

One or more embodiments disclosed herein provide a method of operating a cutting tool downhole that includes running a downhole cutting tool into a wellbore, deploying a first set of expandable cutting arms to an extended position and engaging the extended expandable cutting arms with a first work piece, rotating the downhole cutting tool and cutting the first work piece, deploying a second set of expandable cutting arms during a single trip into a wellbore to an extended position and engaging the extended expandable cutting arms with a second work piece, and rotating the downhole cutting tool and cutting the second work piece. The method may further include deploying a third set of expandable cutting arms during the single trip into the wellbore to an extended position and engaging the extended expandable cutting arms with a third work piece, and rotating the downhole cutting tool and cutting the third work piece. In some embodiments, the first work piece may be an inner/innermost casing and the second work piece may be an outer casing disposed around the inner/innermost casing. In other embodiments, the first work piece may be a casing and the second work piece may be the formation outside of the casing. In other embodiments, the first work piece may be an inner/innermost casing, the second work piece may be an outer casing disposed around the inner/innermost casing, and the third work piece may be the formation outside the outer casing. In still other embodiments, the first work piece may be an inner/innermost casing, the second work piece may be an outer casing disposed around the inner/innermost casing, and the third work piece may be a next outer casing disposed around the outer casing. One of ordinary skill in the art will appreciate that various combinations of work pieces may be in place in the wellbore and may be cut and or removed from downhole using methods disclosed herein.

Although only a few example embodiments have been described in detail above, those skilled in the art will readily appreciate that many modifications are possible in the example embodiments without materially departing from the scope of embodiments disclosed herein. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A downhole cutting tool comprising:

a tool body having a piston assembly disposed in a central bore thereof, the piston assembly configured to translate longitudinally along the central axis of the tool body; and a plurality of cutter knife sets, each of the plurality of cutter knife sets including at least two individual cutter knives circumferentially spaced about a central axis of the tool body, each of the plurality of cutter knife sets coupled to the tool body and configured to selectively engage with the piston assembly to actuate independently and extend outwardly to separately perform a pipe cutting operation, a first cutter knife set of the plurality of cutter knife sets having a diameter in an extended position larger than a diameter in an extended position of a second cutter knife set of the plurality of cutter knife sets, wherein the piston assembly is configured to translate and rotate with respect to the tool body to selectively engage at least one of the plurality of cutter knife sets.

2. The downhole cutting tool of claim 1, wherein a length of at least one cutter knife of the first cutter knife set is longer than a length of at least one cutter knife of the second cutter knife set.

3. The downhole cutting tool of claim 1, further comprising a third cutter knife set having a diameter in an extended position larger than the diameter of the first cutter knife set and the second cutter knife set.

4. The downhole cutting tool of claim 1, further comprising at least one set of underreamer cutting arms.

5. The downhole cutting tool of claim 4, wherein the piston assembly is configured to selectively actuate the at least one set of underreamer cutting arms.

6. The downhole cutting tool of claim 1, further comprising at least one set of milling cutters.

7. The downhole cutting tool of claim 6, wherein the piston assembly is configured to selectively actuate the at least one set of milling cutters.

8. The downhole cutting tool of claim 1, the piston assembly being further configured to selectively engage the second cutter knife set and actuate and extend the second cutter knife set to the extended position while the first cutter knife set remains in a retracted position.

9. A method of operating a cutting tool downhole, the method comprising:

running a downhole cutting tool into a wellbore;

deploying a first set of expandable cutting arms to an extended position and engaging the extended first set of expandable cutting arms with a first work piece;

rotating the downhole cutting tool and cutting the first work piece;

decreasing fluid pressure acting on the downhole cutting tool;

after decreasing fluid pressure acting on the downhole cutting tool, deploying a second set of expandable cutting arms to an extended position and engaging the extended second set of expandable cutting arms with a second work piece, the first and second sets of expandable cutting arms being deployed during a single trip into the wellbore; and rotating the downhole cutting tool and cutting the second work piece, wherein deploying the first and second set of expandable cutting arms includes rotating and axially moving a piston assembly of the downhole cutting tool relative to the downhole cutting tool.

10. The method of claim 9, wherein the first work piece is an inner casing and the second work piece is an outer casing disposed around the inner casing.

11. The method of claim 9, wherein the first work piece is a casing and the second work piece is formation outside of the casing.

12. The method of claim 11, wherein the rotating the downhole cutting tool and cutting the first work piece comprises milling a section of the casing.

13. The method of claim 12, wherein the rotating the downhole cutting tool and cutting the second work piece comprises underreaming an exposed portion of formation through the milled section of the casing.

14. The method of claim 9, further comprising deactuating and retracting the first set of expandable cutting arms.

15. The method of claim 14, wherein retracting the first set of expandable cutting arms includes maintaining the first set of expandable cutting arms retracted while deploying the second set of expandable cutting arms to an extended position.

16. The method of claim 9, further comprising repositioning the downhole cutting tool prior to deploying the second set of expandable cutting arms.

17. The method of claim 9, further comprising:

deploying a third set of expandable cutting arms during the single trip into the wellbore to an extended position and engaging the extended expandable cutting arms with a third work piece; and rotating the downhole cutting, tool and cutting the third work piece.

18. The method of claim 17, wherein the first work piece is an inner casing, the second work piece is an outer casing disposed around the inner casing, and the third work piece is a next outer casing disposed around the outer casing.

19. The method of claim 9, wherein the first set of expandable cutting arms are milling cutters and the second set of expandable cutting arms are underreamer cutting arms.

20. A bottomhole assembly comprising:

a tool body;

a cutter knife set coupled to the tool body, the cutter knife set including at least two individual cutter knives circumferentially spaced about a central axis of the tool body;

an underreamer coupled to the tool body;

a casing mill coupled to the tool body, and an actuation assembly configured to selectively actuate each of the cutter knife set, the underreamer, and the casing mill in a single trip downhole, the actuation assembly including a piston assembly in a central bore of the tool body, the piston assembly including an indexing track to direct selective actuation of at least one of the cutter knife set, the underreamer, or the casing mill.

21. The hottomhole assembly of claim 20, the piston assembly configured to selectively actuate each of the cutter knife set, the underreamer, and the casing mill.

22. The bottomhole assembly of claim 21, the piston assembly configured to selectively actuate the cutter knife set to an extended position while at least one of the underreamer or the casing mill remains in a retracted position.

23. The bottomhole assembly of claim 20, the indexing track being circumferential and including at least:

a first track section which, when engaged with a travel pin, directs selective actuation of the cutter knife set while the underreamer and casing mill are deactivated;

a second track section which, when engaged with the travel pin, directs selective actuation of the underreamer, while the cutter knife set and casing mill are deactivated; and a third track section which, when engaged with the travel pin, directs selective actuation of the casing mill, while the cutter knife set and underreamer are deactivated.

* * * * *